US010653192B2

(12) United States Patent
Chen

(10) Patent No.: US 10,653,192 B2
(45) Date of Patent: May 19, 2020

(54) ARTICLE OF SELF-LIGHT EMITTING CLOTHING

(71) Applicant: DEFEND GROUP CO., LTD., Kaohsiung (TW)

(72) Inventor: Chih-Chiang Chen, Kaohsiung (TW)

(73) Assignee: DEFEND GROUP CO., LTD., Kaohsiung (TW)

( * ) Notice: Subject to any disclaimer, the term of this patent is extended or adjusted under 35 U.S.C. 154(b) by 0 days.

(21) Appl. No.: 16/041,876

(22) Filed: Jul. 23, 2018

(65) Prior Publication Data

US 2019/0021411 A1 Jan. 24, 2019

(30) Foreign Application Priority Data

Jul. 21, 2017 (TW) ..... 106210776 U
Jan. 9, 2018 (TW) ..... 107200366 U

(51) Int. Cl.

| | |
|---|---|
| ***A41D 13/01*** | (2006.01) |
| ***A41D 27/08*** | (2006.01) |
| ***F21W 121/06*** | (2006.01) |
| ***F21Y 115/10*** | (2016.01) |

(52) U.S. Cl.

CPC ..... *A41D 13/01* (2013.01); *A41D 27/085* (2013.01); *F21W 2121/06* (2013.01); *F21Y 2115/10* (2016.08)

(58) Field of Classification Search

CPC ... A41D 13/01; A41D 27/085; F21Y 2115/10; F21W 2121/06

See application file for complete search history.

(56) References Cited

U.S. PATENT DOCUMENTS

2010/0251453 A1* 10/2010 Chen ..... B60Q 1/2673 2/69
2011/0075399 A1* 3/2011 Yuan ..... A41D 13/01 362/103
2016/0348890 A1* 12/2016 Polanowski ..... F21V 33/0008
2018/0048953 A1* 2/2018 Park ..... G06F 3/162

* cited by examiner

*Primary Examiner* — Mary Ellen Bowman
(74) *Attorney, Agent, or Firm* — Bacon & Thomas, PLLC

(57) ABSTRACT

An article of self-light-emitting clothing includes an article of clothing, a driver device and a group of electric coupling switches. The article of clothing includes a light-emitting component, and first and second arrangement areas, and when the article of clothing is folded, the first and second arrangement areas can contact each other; otherwise, the first and second arrangement areas are separated. The driver device includes a battery and a switch circuit. The group of electric coupling switches includes first and second couplers disposed on the first and second arrangement area, respectively. When the first coupler and the second coupler are electrically coupled to each other, the switch circuit is in open-circuit status to disconnect the battery and the light-emitting component. When the first coupler is not electrically coupled to the second coupler, the switch circuit is conducted to enable the battery to supply power to the light-emitting component.

9 Claims, 11 Drawing Sheets

ARTICLE OF SELF-LIGHT EMITTING CLOTHING

BACKGROUND OF THE INVENTION

1. Field of the Invention

The present invention generally relates to an article of light-emitting clothing, more particularly to an article of light-emitting clothing which is able to automatically turn on the light-emitting component to emit light when being worn.

2. Description of the Related Art

An article of clothing added with a reflective device or a light-emitting device can increase the attention of others to improve the user's safety. One of the conventional manners is to attach or sew a reflective object on a surface of an article of clothing, so as to increase safety. As a passive warning device, the reflective vest is unable to produce light refraction warning effect until the reflective vest is illuminated by an external light source. When there is no street light or other light source around in dark environment, the reflective vest is hard to provide warning effect. For example, when a car drives on a bend and approaches a person on the road, the light of car lamp cannot be detected early and cannot illuminate the reflective vest early on the bend, and the reflective vest is unable to produce warning effect, so that a light-emitting vest which lights electrically is developed.

For example, ROC utility model patent No. M442719 discloses a light-emitting fabric with reflective including a fabric body, at least one reflective component, a plurality of light-emitting components, and a circuit assembly. The reflective component is disposed on an outer surface of the fabric body, the light-emitting components are disposed on the fabric body, and the circuit assembly is electrically connected to the light-emitting components. The light-emitting fabric has a reflective effect and a light-emitting effect, so as to enhance the warning function.

The above-mentioned light-emitting fabric includes a switch, and the user must find the switch to turn on the power source to drive the light-emitting components to emit light. However, in many emergency situations, the user may delay to use the light-emitting fabric, for example, in a condition that the user's car stops in an emergency at the roadside for maintenance because of vehicle breakdown, the user may want to wear the light-emitting vest to improve safety, but the user cannot find the switch because of being unfamiliar with the vest, which is not used for a long time.

Similarly, some people in outdoor activities also carry light-emitting clothing based on safety factors, but they may not wear the light-emitting clothing until it becomes dark. However, the user may spend a lot of time to find the switch in a low-light environment.

Another conventional light-emitting clothing can turn on the light by sensing manner, for example, ROC utility model patent No. M448766 discloses a wearing objects with warning function, and ROC utility model patent No. M528935 discloses a wearable bicycle indicating device, and these patents disclose the devices capable of emitting light by the sensing means; however, these conventional devices need to use central processing units or microprocessors for calculation, and also have complicated structures and are expensive. Furthermore, the user is required to turned off power source after every use, and then turn on the switch to activate the power source for use; otherwise, the power stored for the light-emitting component may be exhausted before use.

Furthermore, the applicant has previously gained ROC utility model patent No. M550556 disclosing a self-light-emitting vest, which uses a Hall sensing element to activate lighting function of the vest. Although the Hall sensing element consumes very low power, and the vest can maintain in standby status for a long time when the button cell battery is used to support the sensing function, but a low sensing current in the standby status still may exhaust the power of the battery, and it causes inability to drive the light-emitting component to emit light. Therefore, what is needed is to develop self-light-emitting clothing which can more extend the standby time, to solve the above problems.

SUMMARY OF THE INVENTION

An objective of the present invention is to provide an article of clothing which is able to emit light automatically when being worn, so as to prevent the user from delaying to use because of unable to find the switch in time.

Another objective of the present invention is to provide an article of light-emitting clothing which can turn off power for the light-emitting component automatically when not use, so as to extend standby time of a battery.

According to an embodiment, the present invention provides an article of self-light-emitting clothing comprising an article of clothing, a driver device, and a group of electric coupling switches. The article of clothing includes a light-emitting component, and includes a first arrangement area and a second arrangement area defined on a surface thereof. When the article of clothing is folded, the first arrangement area and the second arrangement area are in contact with each other, and when the article of clothing is unfolded, the first arrangement area and the second arrangement area are separated from each other. The driver device is fixed on the article of clothing, and includes a battery and a switch circuit. The battery is electrically connected to the light-emitting component through the switch circuit. The group of electric coupling switches includes a first coupler and a second coupler disposed on the first arrangement area and the second arrangement area of the article of clothing, respectively. The first coupler is electrically connected to the switch circuit. When the first coupler and the second coupler are electrically coupled to each other, the switch circuit is in open-circuit status to disconnect the battery and the light-emitting component, and when electric coupling between the first coupler and the second coupler is disconnected, the switch circuit is conducted to enable the battery to supply power to the light-emitting component.

In an embodiment, the group of electric coupling switches comprise indirect-sensing electric-coupling switches, and the first coupler is a Hall sensor device, and the second coupler is a magnetic component.

In an embodiment, the group of electric coupling switches comprises direct-contact electric-coupling switch, and the second coupler is electrically connected to the switch circuit.

In an embodiment, the first coupler and the second coupler are conductors.

In an embodiment, the first coupler and the second coupler are metal fastening devices configured to fasten with each other.

In an embodiment, the first coupler and the second coupler are magnetic conductive plates configured to attract to each other.

In an embodiment, the article of clothing is one of a raincoat, a windbreaker, an overcoat, a cloak, a warning vest, a reflective vest, a life jacket, and pet clothing.

In an embodiment, the driver device is disposed on an inner surface of the article of clothing.

In an embodiment, the self-light-emitting clothing further includes a plurality of electric wires disposed inside the article of clothing to serve as conductive wires for electrical connection.

BRIEF DESCRIPTION OF THE DRAWINGS

The structure, operating principle and effects of the present invention will be described in detail by way of various embodiments which are illustrated in the accompanying drawings.

DETAILED DESCRIPTION OF THE PREFERRED EMBODIMENTS

Figure 1:
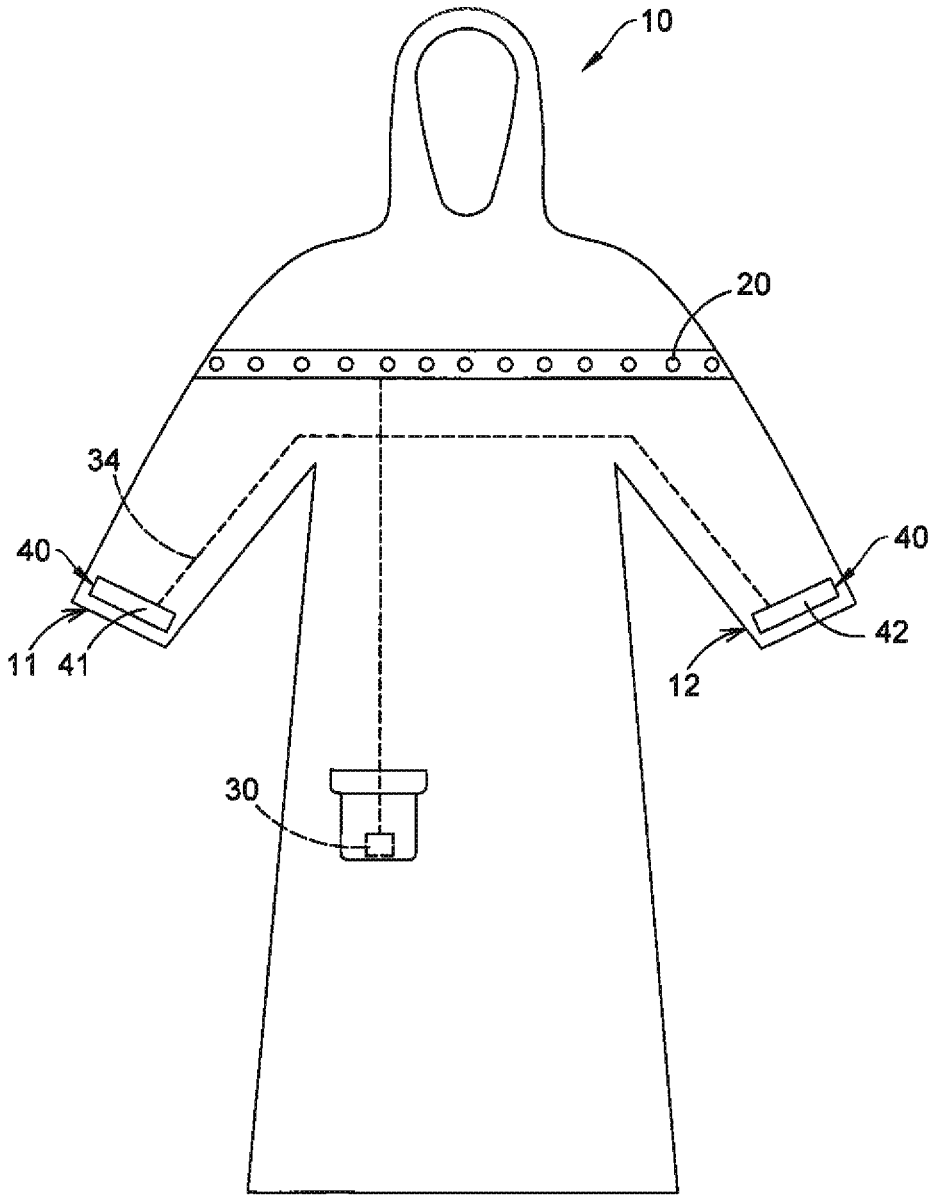
FIG. 1 is a schematic view of an unfolded article of clothing according to a first embodiment of self-light-emitting clothing of the present invention.

The following embodiments of the present invention are herein described in detail with reference to the accompanying drawings. These drawings show specific examples of the embodiments of the present invention. It is to be understood that these embodiments are exemplary implementations and are not to be construed as limiting the scope of the present invention in any way. Further modifications to the disclosed embodiments, as well as other embodiments, are also included within the scope of the appended claims. These embodiments are provided so that this disclosure is thorough and complete, and fully conveys the inventive concept to those skilled in the art. Regarding the drawings, the relative proportions and ratios of elements in the drawings may be exaggerated or diminished in size for the sake of clarity and convenience. Such arbitrary proportions are only illustrative and not limiting in any way. The same reference numbers are used in the drawings and description to refer to the same or like parts.

It is to be understood that, although the terms 'first', 'second', 'third', and so on, may be used herein to describe various elements, these elements should not be limited by these terms. These terms are used only for the purpose of distinguishing one component from another component. Thus, a first element discussed herein could be termed a second element without altering the description of the present disclosure. As used herein, the term "or" includes any and all combinations of one or more of the associated listed items.

It will be understood that when an element or layer is referred to as being "on," "connected to" or "coupled to" another element or layer, it can be directly on, connected or coupled to the other element or layer, or intervening elements or layers may be present. In contrast, when an element is referred to as being "directly on," "directly connected to" or "directly coupled to" another element or layer, there are no intervening elements or layers present.

In addition, unless explicitly described to the contrary, the word "comprise" and variations such as "comprises" or "comprising", will be understood to imply the inclusion of stated elements but not the exclusion of any other elements.

Figure 2:
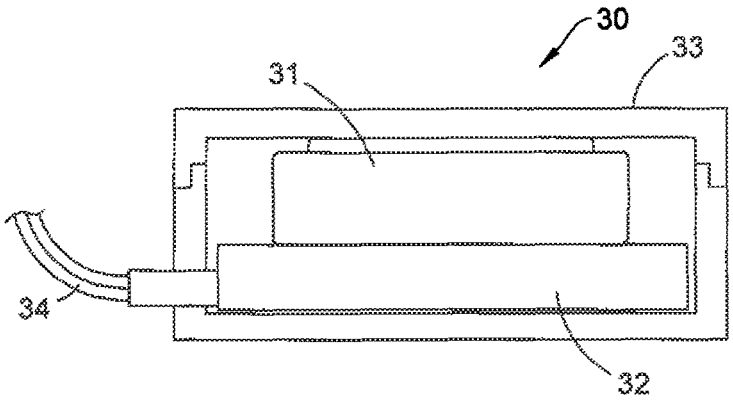
FIG. 2 a structural view of a driver device of according to a first embodiment of self-light-emitting clothing of the present invention.
Figure 3:
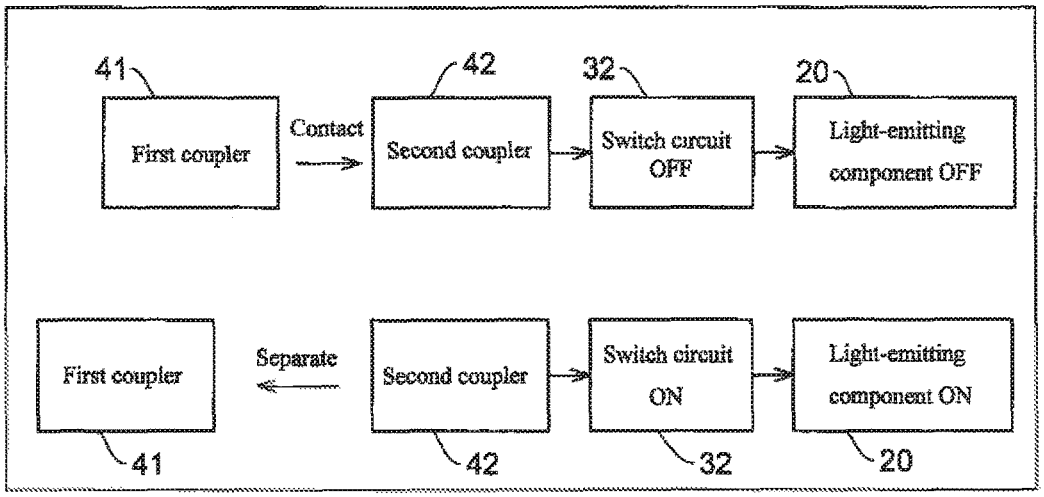
FIG. 3 is a circuit block diagram according to the first embodiment of self-light-emitting clothing of the present invention.

Please refer to FIGS. 1 to 3. FIG. 1 is a schematic view of the unfolded article of clothing according to a first embodiment of self-light-emitting clothing of the present invention, FIG. 2 a structural view of a driver device of according to a first embodiment of self-light-emitting clothing of the present invention, and FIG. 3 is a circuit block diagram according to the first embodiment of self-light-emitting clothing of the present invention. In a preferred embodiment of the present invention, the article of self-light-emitting clothing includes an article of clothing 10, a driver device 30, and a group of electric coupling switches 40. The article of clothing 10 can be one of a raincoat, a windbreaker, an overcoat, a cloak, a warning vest, a reflective vest, a life jacket and pet article of clothing. In this embodiment, the article of clothing 10 is a one-piece raincoat for exemplary illustration. The article of clothing 10 comprises a light-emitting component 20, and it is preferred that the light-emitting component 20 is a LED or other light-emitting component, but the present invention is not limited thereto. The light-emitting component 20 can be disposed on an obvious portion of the article of clothing 10. The article of clothing 10 also includes a first arrangement area 11 and a second arrangement area 12 defined on a surface thereof, and when the article of clothing 10 is folded, the first arrangement area 11 and the second arrangement area 12 can be in contact with each other, and when the article of clothing 10 is unfolded, the first arrangement area 11 and the second arrangement area 12 are separated from each other. For example, in this embodiment, the first arrangement area 11 and the second arrangement area 12 are defined on two sleeves of the article of clothing 10, respectively, and when the article of clothing 10 is folded, the first arrangement area 11 and the second arrangement area 12 can be in contact with each other, and when the article of clothing 10 is unfolded for wearing, the first arrangement area 11 and the second arrangement area 12 are separated from each other.

The driver device 30 is fixed in the article of clothing 10. In this embodiment, the driver device 30 can be disposed in a pocket of the article of clothing 10. It is preferred that the pocket is able to prevent rainwater intrusion; furthermore, the driver device 30 can also be fixed in other portion of the article of clothing 10 by a sewing manner, an adhesive manner, or a high frequency welding manner. In an embodiment, the driver device 30 can be disposed on an inner surface of the article of clothing 10 for better waterproof effect. The driver device 30 includes a battery 31 and a switch circuit 32. The battery 31 and the switch circuit 32 can be disposed in a shell member 33, the switch circuit 32 is electrically connected to external device through an electric wire 34 and the shell member 33, and the battery 31 electrically connected to the light-emitting component 20 through the switch circuit 32.

In this embodiment, the circuit design of the driver device 30 is similar to the circuit design of a disconnection warning device, so the driver device 30 can maintain in standby mode for a long time. When the conductive wire is disconnected, the driver device 30 can emit warning message. The disconnection warning device has applied in applications of home security and product anti-theft, but not applied in the article of clothing yet.

In an embodiment of the present invention, the article of self-light-emitting clothing can comprise a plurality of electric wires 34 disposed inside the article of clothing 10 to serve as conductive wires for electrical connection. The electric wire 34 is configured to electrically connect the driver device 30 to the first coupler 41 and the light-emitting component 20, and the electric wire 34 can be a typical electric wire disposed inside the article of clothing 10. It is preferred that the electric wire 34 can be disposed on an inner surface of the article of clothing 10. With progress of material and textile technology, the electric wire 34 can be the electric wire directly distributed in the article of clothing 10, and can also be conductive conductor knitted with the textile material of the article of clothing 10 integrally.

The battery 31 is a button cell battery, a lithium battery or a rechargeable battery. The button cell battery is also called as a watch battery or a coin battery. The battery 31 can be in electrical contact with the switch circuit 32 directly. The battery 31 provides electrical power to the light-emitting component 20 for emitting light. The switch circuit 32 is disposed on a circuit board, and other electronic circuits of conventional light-emitting circuit can also be disposed on the circuit board, for example, the electronic circuits can include a regulator, a flashing circuit, or a light sensing circuit.

Figure 6:
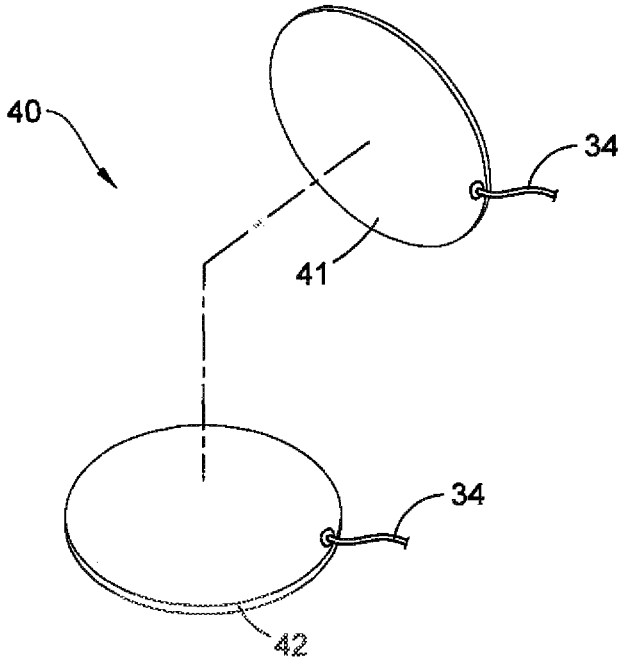
FIG. 6 is a schematic view of a first-type group of electric coupling switches of self-light-emitting clothing of the present invention.

The group of electric coupling switches 40 includes a first coupler 41 and a second coupler 42 disposed on the first arrangement area 11 and the second arrangement area 12 of the article of clothing 10, respectively. The first coupler 41 is electrically connected to the switch circuit 32. In this embodiment, the first coupler 41 and the second coupler 42 are conductors, and the group of electric coupling switches 40 includes direct-contact electric-coupling switch. It should be noted that the direct-contact electric-coupling switch defined in the present invention means that the first coupler 41 and the second coupler 42 of the group of electric coupling switches 40 can be the components electrically connected to each other physically, and the material of the components can be various conductors and the material which can flow current in normal temperature and under normal pressure. When the first coupler 41 and the second coupler 42 are in contact with each other, the current can flow the first coupler 41 and the second coupler 42, and when the first coupler 41 is not in contact with the second coupler 42, the flowing of the current is stopped. Please refer to FIG. 6, which is a schematic view of a first-type group of electric coupling switches of self-light-emitting clothing of the present invention. The first-type group of electric coupling switches 40 is a basic type group of electric coupling switches 40 of the present invention, and each of the first coupler 41 and the second coupler 42 can be a metal circular plate electrically connected to the electric wire 34. When the first coupler 41 contacts the second coupler 42, conductive connection is formed, and when the first coupler 41 is separated from the second coupler 42, open circuit is formed.

In this embodiment, the first coupler 41 and the second coupler 42 can be magnetic conductive plates which can attract to each other, for example, the first coupler 41 and the second coupler 42 can be square plates (as shown in FIG. 1) adhered and fixed on two sleeves of the article of clothing 10, respectively. That is, in this embodiment, the two sleeves are the first arrangement area 11 and the second arrangement area 12 of the article of clothing 10. The light-emitting component 20, the driver device 30 and the group of electric coupling switches 40 disposed in the article of clothing 10 can be used to form an electrical loop which is controlled, by the group of electric coupling switches 40, to disconnect or conduct. Please refer to FIG. 3. As shown in an upper part of FIG. 3, when the article of clothing 10 is folded, the first coupler 41 and the second coupler 42 can be in contact with each other physically to form electric coupling, and in this time, the switch circuit 32 is in an OFF status and the light-emitting component 20 is turned off. As shown in a lower part of FIG. 3, when the user unfolds the article of clothing 10 to wear, the two sleeves must be separated first, so the first coupler 41 can be separated from the second coupler 42 automatically, and after the first coupler 41 leaves away from the second coupler 42, the switch circuit 32 is in ON status and the light-emitting component 20 is turned on.

Figure 4:
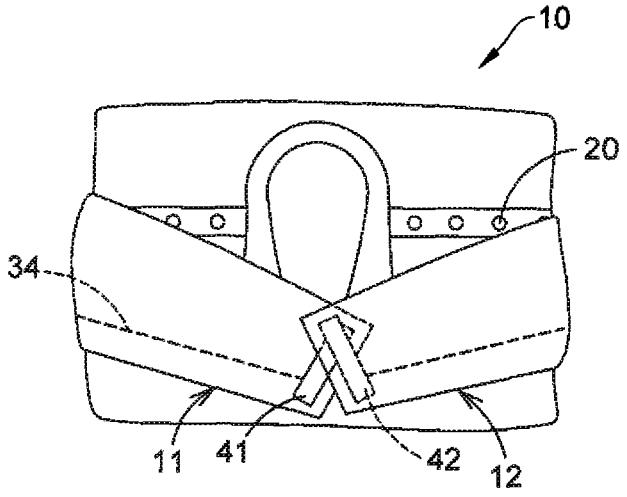
FIG. 4 is a schematic view of the folded article of clothing according to the first embodiment of self-light-emitting clothing of the present invention.

Please refer to FIG. 4, which is a schematic view of the folded article of clothing according to the first embodiment of self-light-emitting clothing of the present invention. When the user does not want to wear the article of clothing 10 and starts to fold the article of clothing 10, the user can overlap the two sleeves first, so that the first arrangement area 11 and the second arrangement area 12 are in contact with each other, so the first coupler 41 and the second coupler 42 are electrically coupled to each other on purpose, and the switch circuit 32 is in open-circuit status to disconnect the battery 31 and the light-emitting component 20.

When electric coupling between the first coupler 41 and the second coupler 42 is disconnected, the switch circuit 32 can be conducted to enable the battery 31 to supply power to the light-emitting component 20, so that user can receive the article of clothing 10 after confirming that the light-emitting component 20 is turned off. As a result, when not in use, the article of clothing 10 can automatically turn off the light-emitting component 20, so as to extend standby time of the battery 31.

When the user wants to wear the article of clothing 10, for example, the user encounters heavy rain in the night and take the article of clothing 10 out of a luggage bag or a storage box of motorcycle, the user must unfold the article of clothing 10 to wear, so the first coupler 41 and the second coupler 42 disposed on the first arrangement area 11 and the second arrangement area 12 of the two sleeves of the article of clothing 10 can be separated from each other automatically; and, after the first coupler 41 leaves away from the second coupler 42, the switch circuit 32 is in ON status to turn on the light-emitting component 20 to emit light, so that the user can turn on the light-emitting component 20 to emit light automatically without finding the switch in time. It should be understood that the circuit of the present invention can include a physical switch, and the user can manually control the physical switch to turn off the light-emitting component 20 for saving power when it is not necessary to turn on the light-emitting component 20 in current environment. According to the above description, the present invention provides an article of clothing which is able to emit light automatically when being worn, so as to prevent the user from delaying to use because of unable to find the switch in time.

Figure 5:
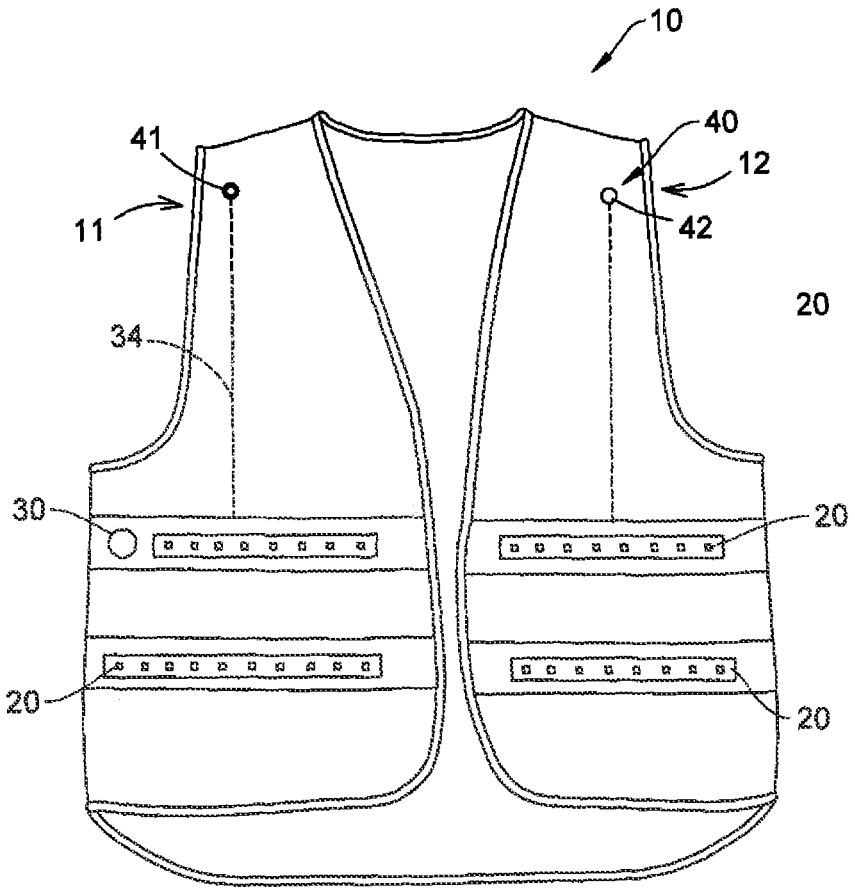
FIG. 5 is a schematic view of the unfolded article of clothing according to a second embodiment of self-light-emitting clothing of the present invention.
Figure 7:
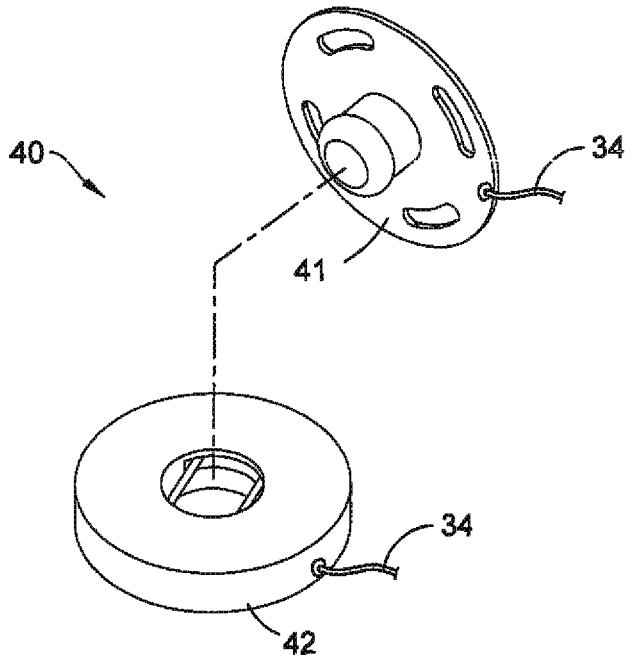
FIG. 7 is a schematic view of a second-type group of electric coupling switches of self-light-emitting clothing of the present invention.
Figure 8:
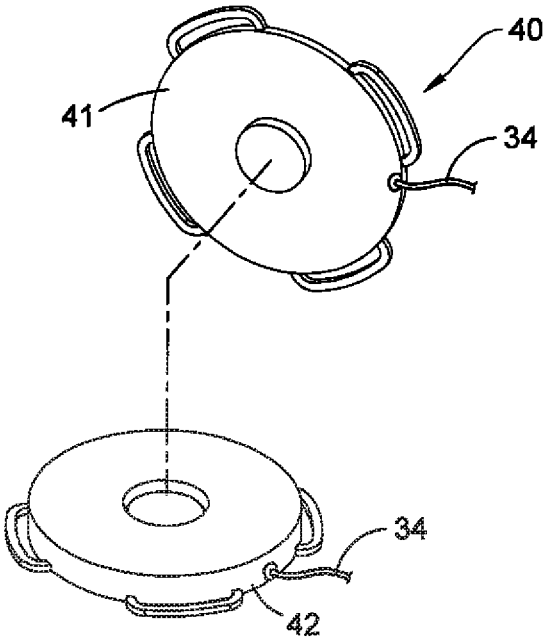
FIG. 8 is a schematic view of a third-type group of electric coupling switches of self-light-emitting clothing of the present invention.

Please refer to FIG. 5, which is a schematic view of unfolded self-light-emitting clothing of a second embodiment of the present invention. The article of clothing 10 of this embodiment is a front open vest. The light-emitting component 20 is disposed on the article of clothing 10 and distributed on a front part and a back part of the vest to enhance warning effect. The driver device 30 is disposed at an appropriate position in the article of clothing 10. In this embodiment, the first coupler 41 and the second coupler 42 is disposed on two sides of the front chest portion of the vest. That is, the first arrangement area 11 and the second arrangement area 12 are defined on two sides of the front chest portion of the article of clothing 10, respectively. The first coupler 41 and the second coupler 42 are electrically connected to driver device 30 through the electric wire 34. In an embodiment, the first coupler 41 and the second coupler 42 can be metal fastening devices configured to fasten with each other. Please refer to FIGS. 7 and 8. FIG. 7 is a schematic view of a second-type group of electric-coupling switches of self-light-emitting clothing of the present invention, and FIG. 8 is a schematic view of third-type group of electric-coupling switches of self-light-emitting clothing of the present invention. The first coupler 41 and the second coupler 42 shown in FIGS. 7 and 8 are different types of metal fastening devices, and are electrically connected to the electric wire 34. When the first coupler 41 is fastened with the second coupler 42, conductive connection is formed; and, when the first coupler 41 is separated from the second coupler 42, the conductive connection is disconnected. When the article of clothing 10 is folded, the first coupler 41 and the second coupler 42 can be fastened to form electrical conduction, so as to turn off the light-emitting component 20. When the user wants to wear the article of clothing 10, the first coupler 41 and the second coupler 42 must be unfastened to separate from each other, so that the driver device 30 is in ON status to turn on the light-emitting component 20 to emit light automatically.

Figure 9:
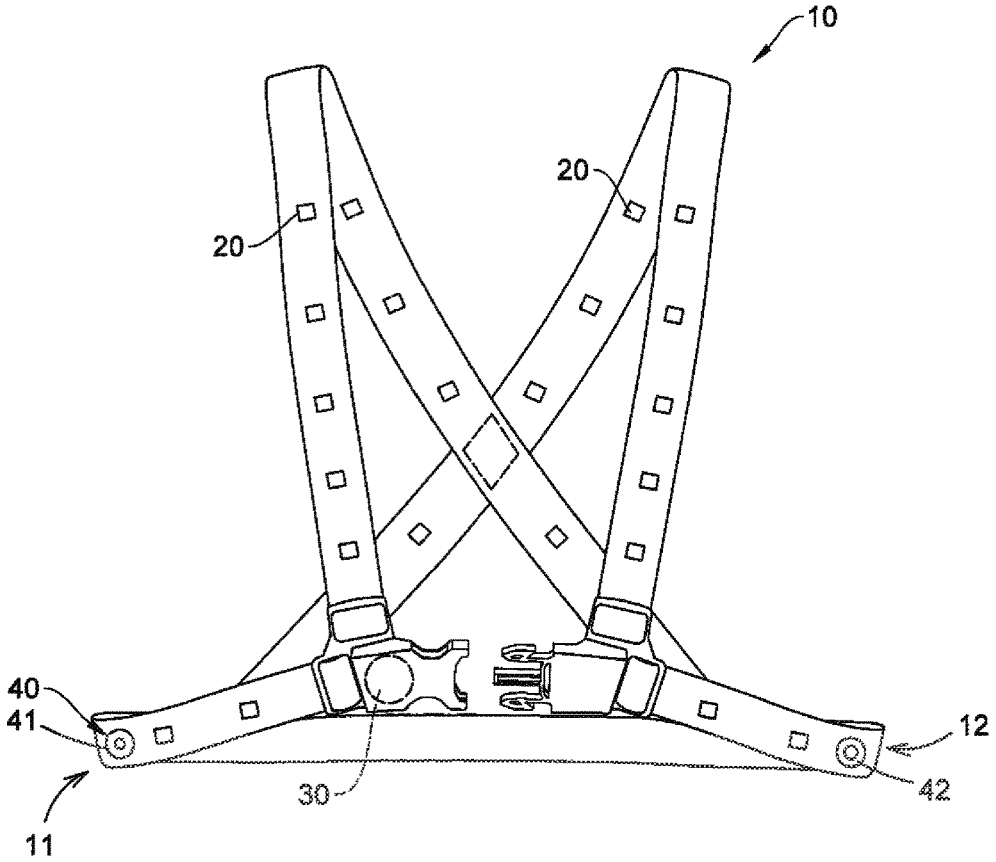
FIG. 9 is a schematic view of the unfolded article of clothing according to a third embodiment of self-light-emitting clothing of the present invention.

Please refer to FIG. 9, which is a schematic view of the unfolded article of clothing of the third embodiment of the self-light-emitting clothing of the present invention. The article of clothing 10 of this embodiment is a vest article of clothing constructed by bandwise objects. For example, a front chest belt, a strap, and a waist belt can form the vest article of clothing, and a fastening device with two separable parts is disposed on the waist belt. The light-emitting component 20 is disposed on the article of clothing 10 and distributed on the belts of different parts of the article of clothing 10. The driver device 30 can be disposed in the fastening device. In this embodiment, the first coupler 41 and the second coupler 42 are disposed on two sides of the waist belt. That is, the first arrangement area 11 and the second arrangement area 12 are defined on two sides of the waist belt of the simple vest, respectively. In an embodiment, the first coupler 41 and the second coupler 42 can be metal fastening devices configured to fasten with each other, and when the article of clothing 10 is folded, the metal fastening devices are fastened to form electrical conduction, so as to turn off the light-emitting component 20. In order to wear the article of clothing 10, the user must unfasten the first coupler 41 and the second coupler 42 to separate from each other, so that the driver device 30 is in ON status to turn on the light-emitting component 20 to emit light automatically.

Figure 10:
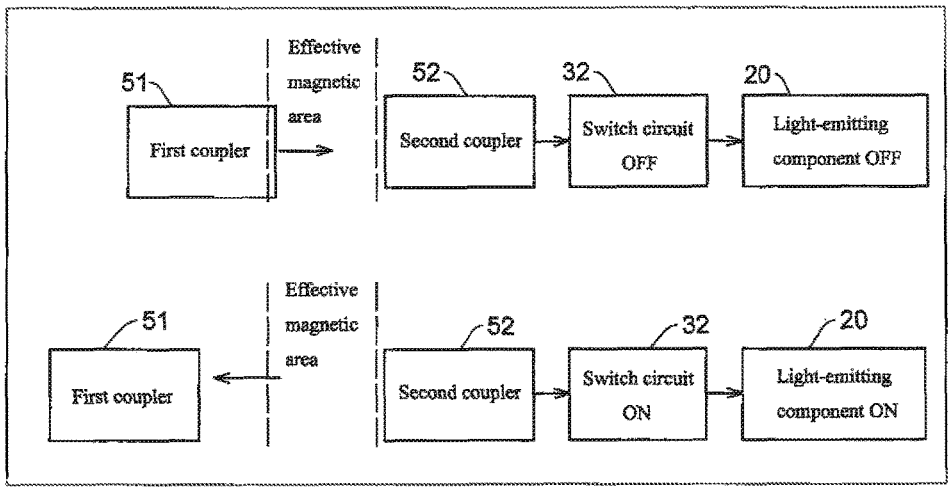
FIG. 10 is a circuit block diagram of self-light-emitting clothing according to a fourth embodiment of self-light-emitting clothing of the present invention.
Figure 11:
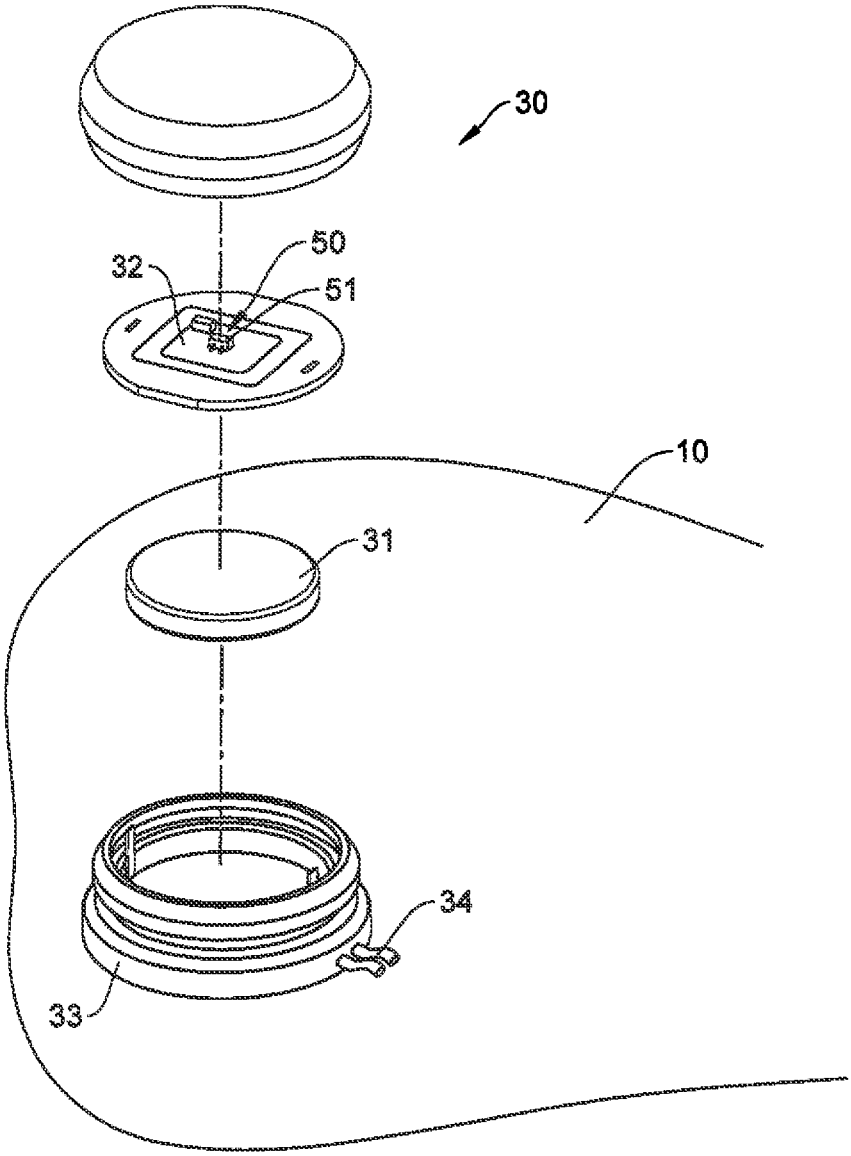
FIG. 11 is a schematic view of structure of a driver device according to the fourth embodiment of self-light-emitting clothing of the present invention.
Figure 12:
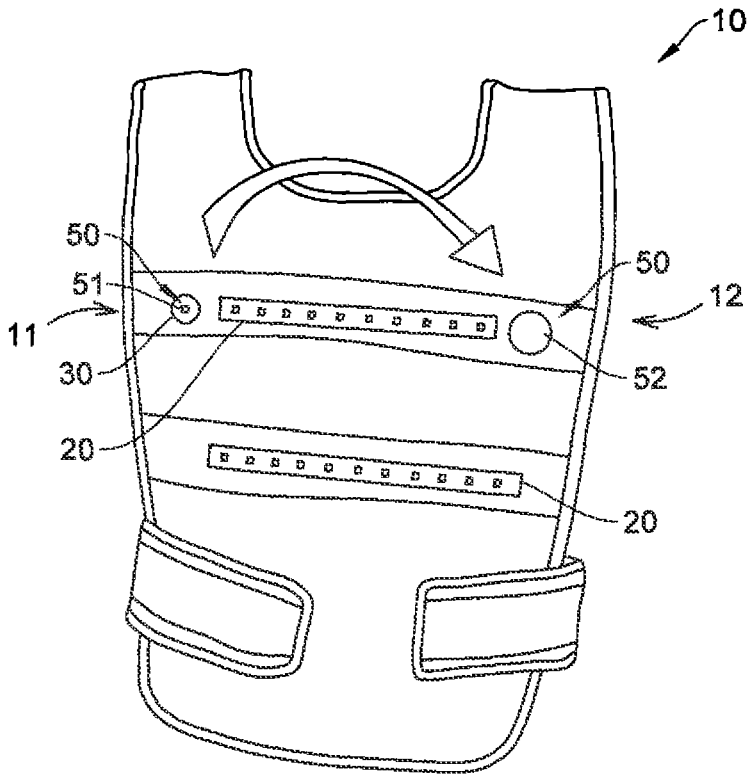
FIG. 12 is a schematic view of the unfolded article of clothing according to the fourth embodiment of self-light-emitting clothing of the present invention.

Please refer to FIGS. 10 to 12. FIG. 10 is a circuit block diagram of self-light-emitting clothing according to a fourth embodiment of self-light-emitting clothing of the present invention, FIG. 11 is a schematic view of structure of a driver device according to the fourth embodiment of self-light-emitting clothing of the present invention, and FIG. 12 is a schematic view of the unfolded article of clothing according to the fourth embodiment of self-light-emitting clothing of the present invention. In this embodiment, the group of electric coupling switches 50 of previous embodiment is replaced by a group of indirect sensing electric coupling switches, and the first coupler 51 is the Hall sensor device and the second coupler 52 is the magnetic component. The Hall sensor device can sense magnetic change around. After the Hall sensor device in cooperation with the magnetic component senses the magnetic change around, the switch circuit 32 is controlled, according to a sensing result, to turn on or off the light-emitting component 20 to emit light. The second coupler 52 can be made by magnetic material, such as a magnet, magnetite, or a soft magnetic strip.

The group of electric coupling switches 50 includes the first coupler 51 and the second coupler 52 disposed on the first arrangement area 11 and the second arrangement area 12 of the article of clothing 10, respectively. The first coupler 51 is electrically connected to the switch circuit 32, and it is not necessary to electrically connect the second coupler 52 and the switch circuit 32. The battery 31 and the switch circuit 32 of the driver device 30 are disposed in the shell member 33, and the switch circuit 32 can be electrically connected to an external device through the electric wire 34 and the shell member 33. The battery 31 is electrically connected to the light-emitting component 20 through the switch circuit 32, and the first coupler 51 and the switch circuit 32 can be disposed on the same circuit board. The indirect-sensing electric-coupling switch defined in the present invention means that the first coupler 51 and the second coupler 52 of the group of electric coupling switches 50 are sensing devices not electrically connected to each other physically, and when the first coupler 51 and the second coupler 52 are moved close to effective magnetic area where the first coupler 51 and the second coupler 52 can affect each other, the switch circuit 32 can be controlled, according to the sensing result, to change a status thereof.

Please refer to the circuit block diagram of FIG. 10. As shown in an upper part of FIG. 10, when the article of clothing 10 is folded, the first coupler 51 and the second coupler 52 are moved into the effective magnetic area to form indirect electric coupling to each other, and at this time, the switch circuit 32 is in OFF status and the light-emitting component 20 is turned off. As shown in a lower part of FIG. 10, when the user unfolds the article of clothing 10 to wear, the two sleeves must be separated from each other first, so the first coupler 51 is separated from the second coupler 52 automatically, and the first coupler 51 and the second coupler 52 leave away from the effective magnetic area; as a result, the switch circuit 32 is in ON status and the light-emitting component 20 is turned on.

Please refer to FIG. 12. In this embodiment, the article of clothing 10 is a two-piece light-emitting vest including a plurality of light-emitting components 20. In this embodiment, the light-emitting component 20 can be a LED strip, and the light-emitting components 20 can be disposed on obvious portions of the article of clothing 10. The article of clothing 10 includes a first arrangement area 11 and a second arrangement area 12 defined on a surface thereof, and when the article of clothing 10 is folded, the first arrangement area 11 and the second arrangement area 12 can be moved close to each other, and when the article of clothing 10 is unfolded, the first arrangement area 11 and the second arrangement area 12 are separated from each other. For example, in this embodiment, the first arrangement area 11 and the second arrangement area 12 are defined on two sides of the front chest portion of the article of clothing 10, respectively, and when the user does not want to wear the article of clothing 10 and starts to fold the article of clothing 10, the two sides of the article of clothing 10 are folded along a centerline, and the first arrangement area 11 and the second arrangement area 12 are moved close to each other, so that the first coupler 51 and the second coupler 52 can enter the effective magnetic area, the switch circuit 32 is in the OFF status (open circuit), and the battery 31 and the light-emitting component 20 are disconnected. The user can receive the article of clothing 10 after confirming that the light-emitting components 20 is turned off. As a result, when the article of clothing 10 is not in use, the light-emitting components 20 can be turned off automatically, thereby extending standby time of the battery 31.

When the user wants to wear the article of clothing 10, the article of clothing 10 can be spread out, and the first coupler 51 at the first arrangement area 11 and the second coupler 52 at the second arrangement area 12 can leave the effective magnetic area, and in this time, the switch circuit 32 is in ON status to turn on the light-emitting component 20 to emit light, so that the user can turn on the light-emitting component 20 to light automatically without finding the switch. It should be understood that, in this embodiment, the physical switch can also be disposed on the circuit, and the user can manually control the physical switch to turn off the light-emitting component 20 for saving power when the light emitted from the light-emitting component 20 is not required in environment. According to the above description, the present invention provides an article of clothing which is able to emit light automatically when being worn, thereby preventing the user from delaying to use because of unable to find the switch.

Figure 13:
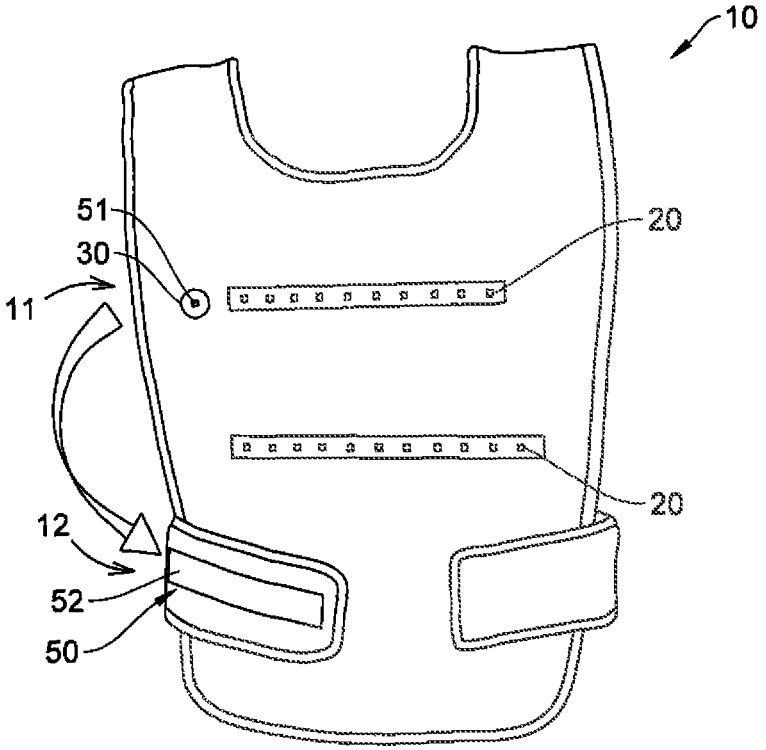
FIG. 13 is a schematic view of the unfolded article of clothing according to a fifth embodiment of self-light-emitting clothing of the present invention.

FIG. 13 is a schematic view of the unfolded article of clothing according to a fifth embodiment of self-light-emitting clothing of the present invention. This embodiment is substantially the same as the fourth embodiment, and the difference between the fifth embodiment and the fourth embodiment is that the first arrangement area 11 and the second arrangement area 12 of the fifth embodiment are defined on upper and lower positions of a front side of the article of clothing 10, respectively, and the second coupler 52 is implemented by a magnetic component having a larger area. When the user does not want to wear the article of clothing 10 and start folding the article of clothing 10 longitudinally, the first arrangement area 11 and the second arrangement area 12 are moved close to each other, and in this time, the second coupler 52, which is a magnetic component having a larger area, can facilitate the first coupler 51 to enter the effective magnetic area of the second coupler 52, so that the light-emitting component 20 can be turned off during the folding process, and the user can receive the article of clothing 10. When the user wants to wear the article of clothing 10, the article of clothing 10 is spread out, and the first coupler 51 at the first arrangement area 11 and the second coupler 52 at the second arrangement area 12 can leave away from the effective magnetic area easily, and in this time, the switch circuit 32 can be in ON status to turn on the light-emitting component 20 to emit light, so that the user can turn on the light-emitting component 20 to light automatically without finding the switch.

The present invention disclosed herein has been described by means of specific embodiments. However, numerous modifications, variations and enhancements can be made thereto by those skilled in the art without departing from the spirit and scope of the disclosure set forth in the claims.

What is claimed is:

1. An article of self-light-emitting clothing, comprising:

an article of clothing comprising a light-emitting component, and comprising a first arrangement area and a second arrangement area defined on a surface thereof, wherein when the article of clothing is folded, the first arrangement area and the second arrangement area are in contact with each other, and when the article of clothing is unfolded, the first arrangement area and the second arrangement area are separated from each other;

a driver device fixed on the article of clothing, and comprising a battery and a switch circuit, wherein the battery is electrically connected to the light-emitting component through the switch circuit; and a group of electric coupling switches comprising a first coupler and a second coupler disposed on the first arrangement area and the second arrangement area of the article of clothing, respectively, wherein the first coupler is electrically connected to the switch circuit;

wherein when the first coupler and the second coupler are electrically coupled to each other, the switch circuit is in open-circuit status to disconnect the battery and the light-emitting component, and when electric coupling between the first coupler and the second coupler is disconnected, the switch circuit is conducted to enable the battery to supply power to the light-emitting component.

2. The article of self-light-emitting clothing according to claim 1, wherein the group of electric coupling switches comprises indirect-sensing electric-coupling switches, and the first coupler is a Hall sensor device, and the second coupler is a magnetic component.

3. The article of self-light-emitting clothing according to claim 1, wherein the group of electric coupling switches comprises direct-contact electric-coupling switches, and the second coupler is electrically connected to the switch circuit.

4. The article of self-light-emitting clothing according to claim 3, wherein the first coupler and the second coupler are conductors.

5. The article of self-light-emitting clothing according to claim 4, wherein the first coupler and the second coupler are metal fastening devices configured to fasten with each other.

6. The article of self-light-emitting clothing according to claim 4, wherein the first coupler and the second coupler are magnetic conductive plates configured to attract to each other.

7. The article of self-light-emitting clothing according to claim 1, wherein the article of clothing is one of a raincoat, a windbreaker, an overcoat, a cloak, a warning vest, a reflective vest, a life jacket, and pet clothing.

8. The article of self-light-emitting clothing according to claim 1, wherein the driver device is disposed on an inner surface of the article of clothing.

9. The article of self-light-emitting clothing according to claim 1, further comprising a plurality of electric wires disposed inside the article of clothing to serve as conductive wires for electrical connection.

* * * * *